US006644585B2

(12) United States Patent
Gutierrez et al.

(10) Patent No.: US 6,644,585 B2
(45) Date of Patent: Nov. 11, 2003

(54) SOLENOID COIL ASSEMBLY AND METHOD FOR WINDING COILS

(75) Inventors: Roberto Gutierrez, El Paso, TX (US); Samuel S Newcomer, El Paso, TX (US); Alvaro J Carrillo, Chihuahua (MX); German Alvizouri, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 67 days.

(21) Appl. No.: 10/012,855

(22) Filed: Dec. 10, 2001

(65) Prior Publication Data

US 2003/0107464 A1 Jun. 12, 2003

(51) Int. Cl.[7] ..... B65M 81/06
(52) U.S. Cl. ..... 242/443; 242/157 R; 336/208
(58) Field of Search ..... 242/159, 332, 242/443, 338, 157.1, 157 R; 336/192, 208; 29/602.1, 605

(56) References Cited

U.S. PATENT DOCUMENTS 3,833,184 A * 9/1974 Hara et al. ..... 242/158 R
4,558,200 A * 12/1985 Weigand, Jr. ..... 219/85.15
5,524,334 A * 6/1996 Boesel ..... 29/605
5,535,083 A * 7/1996 Sako et al. ..... 361/38
6,215,385 B1 4/2001 Ogden ..... 336/96
6,369,682 B1 * 4/2002 Thompson, Jr. et al. .... 336/192
6,556,116 B2 4/2003 Skinner et al. ..... 336/96
6,556,118 B1 4/2003 Skinner ..... 336/182

FOREIGN PATENT DOCUMENTS

JP 358116714 A * 7/1983

* cited by examiner

*Primary Examiner*—Ann Mai
(74) *Attorney, Agent, or Firm*—Margaret A. Dobrowitsky

(57) ABSTRACT

A coil assembly includes a spool that is rotatably attached to a connector. In order to wind a coil on the spool, the spool is rotated with respect to the connector until the connector does not interfere with the winding bay on the spool. Thereafter, a wire is wound around the spool within the winding bay to form the coil. Once the coil is complete, the spool can be rotated with respect to the connector until a locking mechanism on the spool engages a corresponding locking mechanism on the connector. Thus, a complete coil assembly can be manufactured in one operation with minimal manufacturing steps.

13 Claims, 2 Drawing Sheets

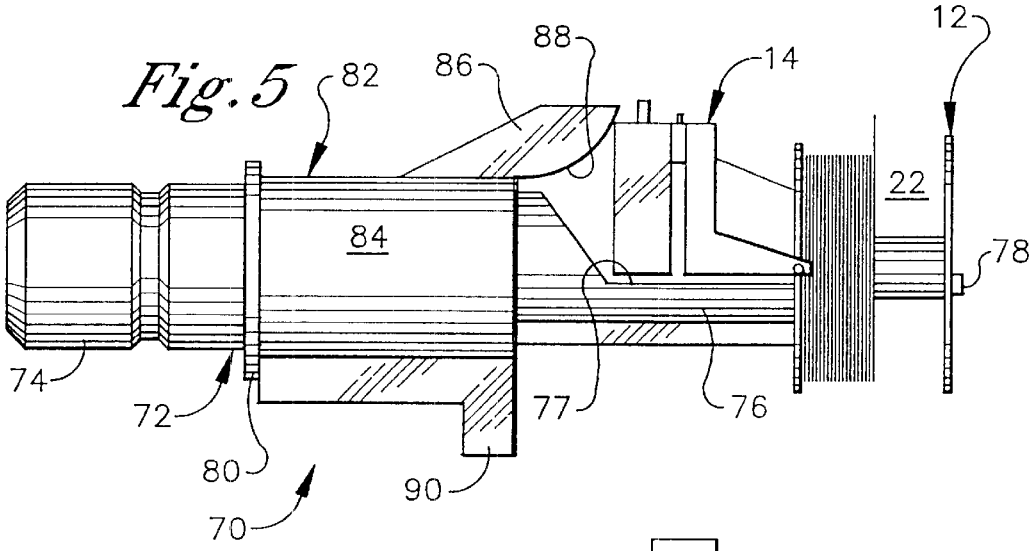
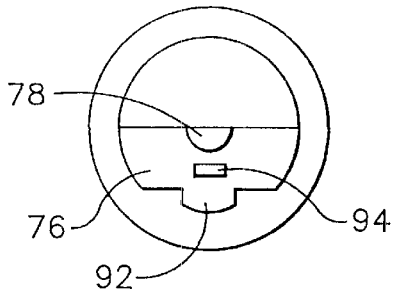
Fig. 6
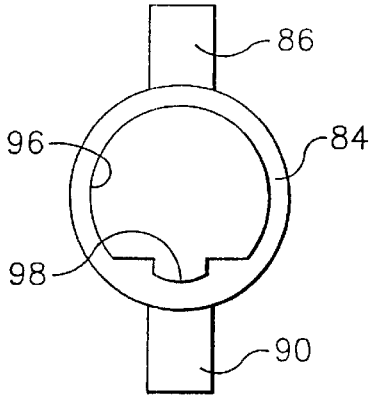
Fig. 7
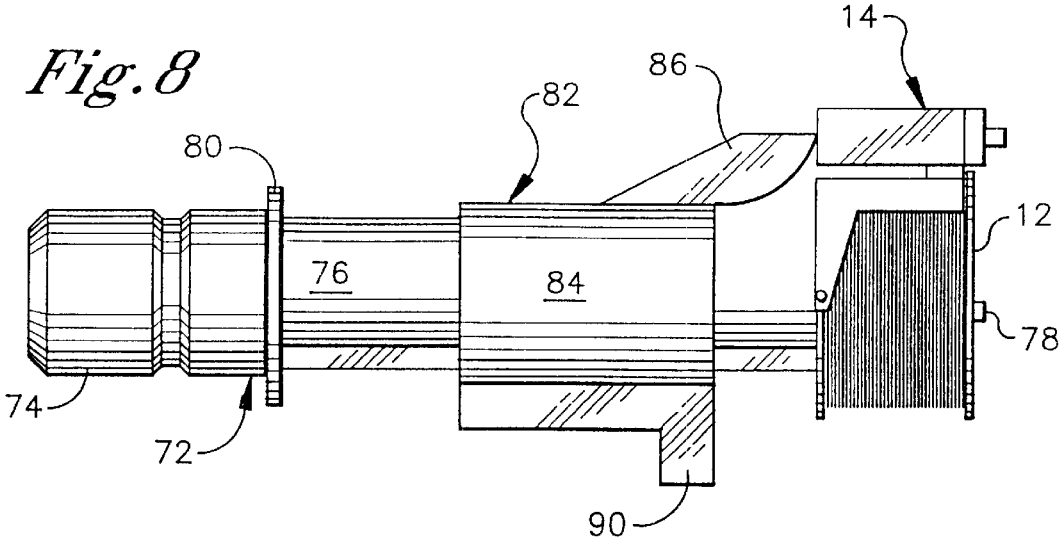

SOLENOID COIL ASSEMBLY AND METHOD FOR WINDING COILS

TECHNICAL FIELD

The present invention relates to solenoids and actuators.

BACKGROUND OF THE INVENTION

Modern motor vehicles are equipped with numerous vehicle subsystems that are designed to increase the comfort and safety of drivers and passengers. For example, a vehicle can include an anti-lock braking system, a traction control system, a speed control system, and/or a vehicle stability enhancement control system. In turn, each subsystem can include numerous electromagnetic sensors and/or actuators that utilize electric coils to move plungers when energized or to provide control signals in response to changes in magnetic flux around the sensing coils.

In general, these coils include a plastic "I" shaped spool that include a winding surface or "bay" with a thin wire wound there around to form the coil. The ends of the wire are connected to terminals that can be electrically connected to a control system to allow the coil to be energized or to send a signal to the control system. A plunger or a sensing structure can be disposed within the spool, i.e., within the coil.

Manufacturing this type of coil is often complicated by the need to attach the coil to an electric connector. If the completed coil assembly is designed so that the connector does not interfere with the winding bay on the spool, it is relatively easy to wind the coil and terminate the wire at the connector in one operation. Unfortunately, in most cases, the completed coil assembly is such that the connector interferes with the winding bay during winding. To avoid interference, the coil is wound first and then a series of interim steps is performed in order to complete the assembly with a connector. For example, the coil can be wound around a molded spool and then connected to a connector that is molded in a separate process. Or, the coil can be wound around a molded spool and then a connector can be overmolded around the completed coil assembly. In either situation, the extra process steps increase the manufacturing costs.

The present invention has recognized these prior art drawbacks, and has provided the below-disclosed solutions to one or more of the prior art deficiencies.

SUMMARY OF THE INVENTION

A coil assembly includes a connector and a spool. The spool is pivotally attached to the connector. Moreover, the spool supports a coil of wire. In a preferred embodiment, the connector includes a first arm and a second arm that pivotally support the spool. Preferably, the first arm forms a first axle channel and the second arm forms a second axle channel. The spool includes a first axle and a second axle. Each axle rotatably fits into a respective axle channel to allow the spool to pivot with respect to the connector around the axles. Preferably, the arms are shaped to match the outer periphery of the spool.

In a preferred embodiment, the coil assembly includes a locking mechanism that prevents the spool from pivoting with respect to the connector. Preferably, the connector defines a top and the spool defines an outer periphery. The locking mechanism includes a post that extends from the top of the connector and a tongue that extends from the outer periphery of the spool. The tongue forms a slot that engages the post.

In another aspect of the present invention, a method for winding a coil on a spool includes providing a spool that has a winding bay. The spool is pivotally attached to a connector that has two terminals. The spool is pivoted with respect to the connector so that it does not interfere with the winding bay. A wire is connected to one of the terminals. Then, the wire is wound around the spool to form a coil.

In yet another aspect of the present invention, a coil assembly includes connector means, spool means, and coil means disposed around the spool means. This aspect of the present invention also includes means for pivotally attaching the connector means to the spool means.

In still another aspect of the present invention, a device is used to pivot a connector with respect to a spool that defines a winding bay. The device includes an arbor that supports the spool and a connector shuttle that is slidably disposed on the arbor. The connector shuttle is movable to pivot the connector between a winding position, wherein the connector does not interfere with the winding bay, and an assembled position, wherein the connector engages the spool.

In yet still another aspect of the present invention, a method for winding a coil on a spool includes providing an arbor and a connector shuttle that is slidably disposed on the arbor. A spool that has a winding bay is installed on the arbor. The spool is pivotably attached to a connector that has two terminals. The connector is pivoted with respect to the spool so that the connector does not interfere with the winding bay. A wire is connected to one of the terminals and then wound around the spool to form a coil.

The present invention will now be described, by way of example, with reference to the accompanying drawings, in which:

BRIEF DESCRIPTION OF THE DRAWINGS

FIG. 5 is a side plan view of a shuttling assembly in the winding position;

FIG. 6 is an end view of the arbor;

FIG. 7 is an end view of the shuttle; and

FIG. 8 is a side plan view of a shuttling assembly in the assembled position.

DESCRIPTION OF AN EMBODIMENT OF THE INVENTION

Figure 1:
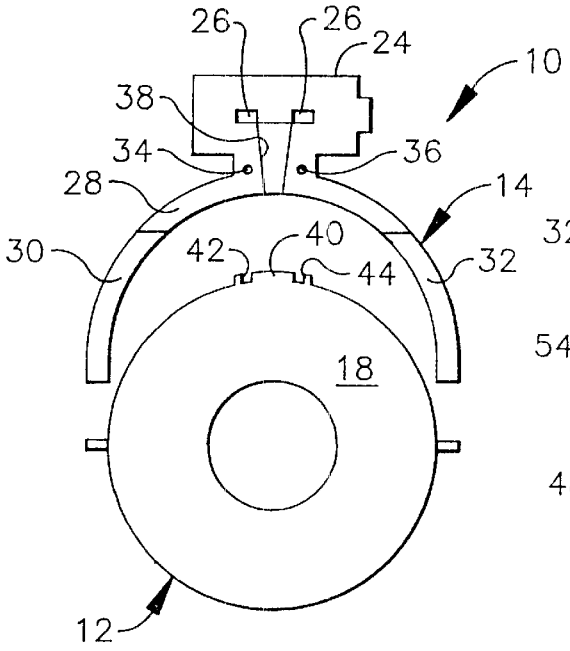
FIG. 1 is an exploded top plan view of the coil assembly.
Figure 2:
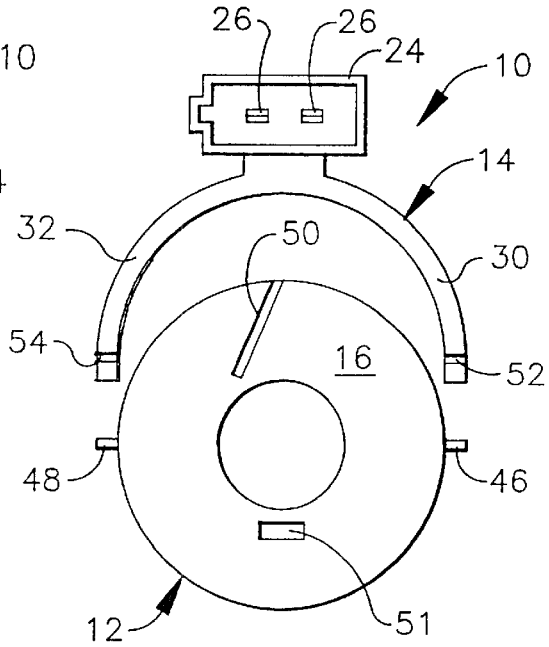
FIG. 2 is an exploded bottom plan view of the coil assembly.
Figure 3:
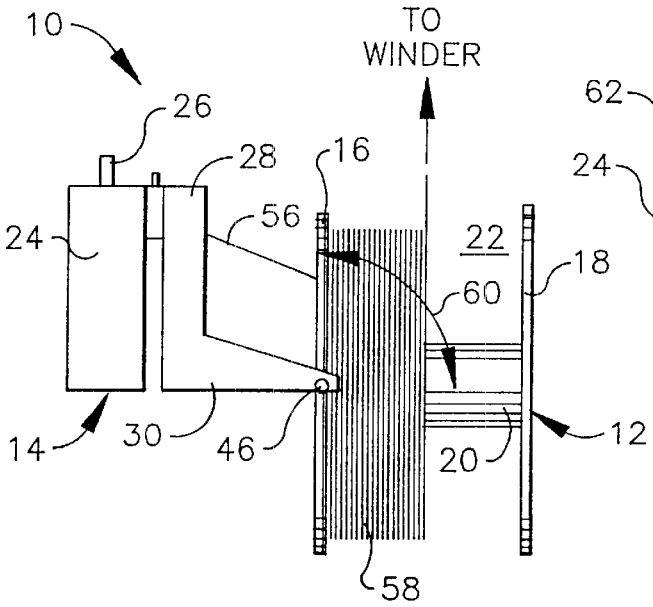
FIG. 3 is a side plan view of the coil assembly with the spool rotated perpendicular to the connector.

Referring to FIGS. 1–3, a coil assembly is shown and generally designated 10. FIGS. 1–3 show that the coil assembly 10 includes a generally "I" shaped spool 12 and a connector 14. FIGS. 1–3 show that the spool 12 includes a generally disk-shaped first end cap 16, a generally disk-shaped second end cap 18, and a hollow, generally cylindrical shaft 20 therebetween. A coil winding bay 22 is formed around the shaft 20 between the end caps 16, 18.

As shown in FIGS. 1–3, the connector 14 includes a female housing 24 in which a correspondingly sized and shaped male connector (not shown) is inserted. The male connector can be connected to a control system wire harness. A pair of terminals 26 are placed within the housing 24 and at least partially extend therefrom. FIGS. 1–3 show that the connector 14 also includes a curved wall 28 having a curved first arm 30 and a curved second arm 32 extending therefrom. It is to be understood that the curved wall 28 and the curved arms 30, 32 have a radius of curvature that matches the outer periphery of the end caps 16, 18.

Referring particularly to FIG. 1, a relatively small, solid, generally cylindrical first post 34 and a relatively small, solid, generally cylindrical second post 36 extend perpendicularly from the top of the connector 14. Moreover, a channel 38 leading to the terminals 24 is formed in the top of the connector 14 between the posts 34, 36. It is to be appreciated that the channel 38 facilitates the connection of the coil wire, described below, to the terminals 24. FIG. 1 shows that the second end cap 18 includes a tongue 40 that extends radially from the outer periphery of the second end cap 18. The tongue 40 is formed with a first slot 42 and a second slot 44 that are configured to receive the first post 34 and the second post 36, respectively.

As shown in FIG. 2, a solid generally cylindrical first axle 46 and a solid generally cylindrical second axle 48 extend radially from the outer periphery of the first end cap 16. It is to be appreciated that the axles 46, 48 are identical to each other and they are spaced one hundred and eighty degrees apart (180°) from each other along the outer periphery of the first end cap 16. FIG. 2 shows that the first end cap 16 also forms a slot 50 that facilitates the connection of the coil wire, described below, to one of the terminals 24. Further, the first end cap 16 forms a relatively small, preferably rectangular indentation 51 that is sized and shaped to receive a correspondingly sized and shaped protrusion that extends from the end of the winding arbor, described below.

Still referring to FIG. 2, the first curved arm 30 is formed with a first axle channel 52 and the second curved arm 32 is formed with a second axle channel 54. It is to be appreciated that the axle channels 52, 54 are configured to closely receive the axles 46, 48 that extend from the first end cap 16. The axles 46, 48 can rotate in their respective channels 52, 54. Thus, the spool 12 is pivotably attached to the connector 14.

Referring now to FIG. 3, the coil assembly 10 is shown with the spool 12 attached to the connector 14 for winding of the coil. In the configuration shown, the axles 46, 48 that extend from the first end cap 16 are installed in the axle channels 52, 54, but the posts 34, 36 on top of the connector 14 are not received in the tongue 40 that extends from the second end cap 18. To facilitate winding, the spool 12 is disposed perpendicular to the connector 14 so that the connector 14 does not interfere with the winding bay 22. As shown in FIG. 3, a relatively thin wire 56 is connected to one of the terminals 26, routed through the slot 50, and then wound around the spool 12 numerous times in order to form a coil 58.

Figure 4:
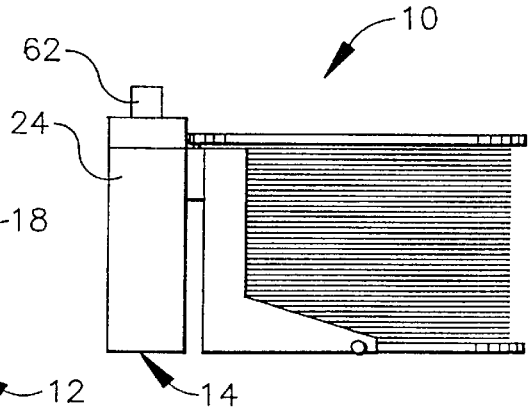
FIG. 4 is a side plan view of the completed coil assembly with the spool engaged with the connector.

Preferably, after the coil 58 is completely formed, the connector 14 is rotated with respect to the spool 12 around the axles 46, 48, as indicated by arc 60, until the connector 14 is parallel to the spool 12 and the slots 42, 44 in the tongue 40 engage the posts 34, 36 on top of the connector 14. The posts 34, 36 are received in the slots 42, 44 in an interference fit to hold the assembly in the closed position shown in FIG. 4. Thereafter, the coil wire 56 is routed back through the slot 50 and then connected to the remaining terminal 26. A cap 62 is placed over the terminals 26, as shown in FIG. 4. It can be appreciated that the cooperation of structure between the posts 34, 36 and the slots 42, 44 acts as a locking mechanism to lock the spool 12 to the connector 14 after the coil 58 has been wound. As stated above, in a preferred embodiment, the spool 12 remains stationary and the connector 14 is rotated. However, it can be appreciated that the connector 14 can be held stationary and the spool 12 rotated.

FIG. 5 shows one exemplary shuttling assembly, generally designated 70, that can be used to rotate the connector 14 with respect to the spool 12, after the coil 58 is wound, so that the posts 34, 36 on the connector 14 engage the slots 42, 44 on the spool 12 to form the coil assembly 10 shown in FIG. 4. FIG. 5 shows that the shuttling assembly 70 includes a solid generally cylindrical winding arbor 72 having a winding machine shaft portion 74 that is sized and shaped to be inserted into a winding machine (not shown), e.g., into the winding machine chuck. The arbor 72 further includes a shuttle support shaft portion 76 and a spool support shaft portion 78. A stop 80 extends radially from the arbor and separates the winding machine shaft portion 74 from the shuttle support shaft portion 76.

As shown in FIG. 5, a connector shuttle 82 is slidably disposed on the shuttle support shaft portion 76 of the arbor 72. FIG. 5 shows that the connector shuttle 82 includes a collar 84 that fits around the shuttle support shaft portion 76. An arm 86 extends tangentially from the collar 84, preferably from the top of the collar 84. The arm 86 includes a cam surface 88 that pushes against connector 14 as the connector shuttle 82 moves to the right looking at FIG. 5. The curved shape of the cam surface 88 allows the connector 14 to slide along the arm 86 as the connector shuttle 82 moves into the assembled position, i.e., when the connector 14 engages the spool 12, as described below.

As shown, a counter balance 90 extends from the collar 84 opposite the arm 86. It is to be appreciated that the counter balance 90 balances the shuttle 82 to keep it from binding on the arbor 72 as it is moved along the length of the shuttle support shaft portion 76. The counter balance 90 also balances the shuttle 82 when the arbor 72 is rotated in order to wind the coil 58 onto the spool 12. FIG. 5 further shows that the shuttle support shaft portion 76 is formed with a notch 77 to allow the connector 14 to pivot completely out of the way of the winding bay 22 when the spool 12 is placed on the spool support shaft portion 78 for winding.

Referring to FIG. 6, the shuttle support shaft portion 76 is machined, or otherwise formed, with a tongue 92 along the entire length of the shuttle support shaft portion 76. Moreover, the end of the shuttle support shaft portion 76 includes a small protrusion 94 that engages the indentation 51 (FIG. 2) formed in the first end cap 16 of the spool 12 when the spool 12 is placed on the spool support shaft portion 78 of the arbor 72 for winding.

FIG. 7 shows that the collar 84 includes an internal bore 96 formed with a groove 98 that is sized and shaped to receive the tongue 92 formed along the length of the shuttle support shaft portion 76. The groove 98 engages the tongue 92 to keep the connector shuttle 82 from rotating with respect to the arbor 72 as it slides thereon.

Before winding, the connector shuttle 82 is moved to the left, looking at FIGS. 5 and 8, along the shuttle support shaft portion 76 of the arbor 72 until it is immediately adjacent to the stop 80. The spool 12 is inserted over the spool support shaft portion 78 so that the indentation 51 formed by the spool 12 engages the protrusion 94 formed by the winding arbor 72. As shown in FIG. 5, the connector 14 is rotated approximately ninety degrees (90°) with respect to the spool 12 so as to not obstruct the winding bay 22.

After the coil 58 is completely wound, the connector shuttle 82 is moved along the shuttle support shaft portion 76, to the right looking at FIGS. 5 and 8, until the connector shuttle 82 is in the assembled position, as shown in FIG. 8. It is to be understood that a force, represented by arrow 100, can be applied to the shuttle 82, e.g., on the counter balance 90, in order to move the connector shuttle 82 into the assembled position. The force can be applied to the shuttle 82 in a number of ways. For example, the winding machine (not shown) in which the arbor 72 is inserted can include a bar or arm that is actuated by a servo motor in order to engage the shuttle 82 and move it as described above. On the other hand, the winding machine can include one or more hydraulic or pneumatic pistons that move the shuttle 82, directly or through a bar or arm, into the assembled positioned after the coil 58 is wound. It is to be appreciated that a typical winding machine includes numerous rotational and servo motors and pneumatic actuators that are incorporated into the machine in order to provide other functions, e.g., cutting the wire 56 after the coil 58 is wound. Thus, it could be quite easy to adapt an existing winding machine so that it will automatically assemble the coil assembly 10 after the coil 58 is wound.

It is to be understood that in the assembled position, the connector 14 completely engages the spool 12, i.e., the posts 34, 36 formed by the connector 14 engage the opposing slots 42, 44 formed by the spool 12, to form the completed coil assembly 10, shown in FIG. 4. After the coil assembly 10 is fully assembled, the connector shuttle 82 can be moved to the left, looking at FIGS. 5 and 8, until the connector shuttle 82 is adjacent to the stop 80.

With the configuration of structure described above, it is to be appreciated the pivot connection between the spool 12 and the connector 14 allows the spool 12 to be rotated away from the connector 14 so that the connector does not interfere with the winding bay 22, as shown in FIG. 3, while the coil 58 is wound around the spool 12. Then, after the coil 58 is wound, the spool 12 is rotated back toward the connector 14 so that the posts 34, 36 formed by the connector engage the slots 42, 44 formed by the spool 12. Thus, a complete coil assembly 10 can be manufactured in one operation with minimal steps thereby reducing the costs associated with manufacturing the coil assembly 10. It is also to be appreciated that the pivot connection and locking mechanism described above, or similar means, can be used to attach a spool and connector of nearly any geometry to each other.

While the particular SOLENOID COIL ASSEMBLY AND METHOD FOR WINDING COILS as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A method for winding a coil on a spool comprising the acts of:

providing a spool having a winding bay, the spool being pivotally attached to a connector having at least two terminals;

pivoting the connector with respect to the spool so the connector does not interfere with the winding bay;

connecting a wire to at least one terminal; and winding the wire around the spool to form a coil.

2. The method of claim 1, further comprising the act of:

pivoting the connector with respect to the spool until a locking mechanism on the spool engages a corresponding locking mechanism on the connector.

3. The method of claim 2, further comprising the act of:

connecting the wire to at least one other terminal.

4. The method of claim 3, further comprising the act of:

installing a cap over the terminals.

5. A device for pivoting a connector with respect to a spool defining a winding bay, the device comprising:

at least one arbor supporting the spool; and at least one connector shuttle slidably disposed on the arbor, the connector shuttle being movable to pivot the connector between a winding position, wherein the connector does not interfere with the winding bay, and an assembled position, wherein the connector engages the spool.

6. The device of claim 5, wherein the connector shuttle is keyed to the arbor such that the connector shuttle can not rotate with respect to the arbor.

7. The device of claim 6, wherein the arbor includes a shuttle support shaft portion along which the connector shuttle slides and a spool support shaft portion on which the spool can be placed for winding.

8. The device of claim 6, wherein the arbor includes a winding machine shaft portion that is configured to be engaged by a winding machine.

9. The device of claim 6, wherein the connector shuttle includes an arm formed with a cam surface the connector sliding along the cam surface as the connector pivots with respect to the spool.

10. A method for winding a coil on a spool comprising the acts of:

providing an arbor;

providing a connector shuttle slidably disposed on the arbor;

installing a spool on the arbor the spool having a winding bay, the spool being pivotably attached to a connector having at least two terminals;

pivoting the connector with respect to the spool so the connector does not interfere with the winding bay;

connecting a wire to at least one terminal; and winding the wire around the spool to form a coil.

11. The method of claim 10, further comprising the act of:

moving the connector shuttle with respect to the arbor so that the connector pivots with respect to the spool until a locking mechanism on the spool engages a corresponding locking mechanism on the connector.

12. The method of claim 11, further comprising the act of:

connecting the wire to at least one other terminal.

13. The method of claim 20, further comprising the act of:

installing a cap over the terminals.

* * * * *